US006384361B1

(12) United States Patent
Vijaykumar

(10) Patent No.: US 6,384,361 B1
(45) Date of Patent: May 7, 2002

(54) ERROR FREE TRAYS FOR BIN SORTING

(75) Inventor: Gune Rahul Vijaykumar, Pakkred (TH)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/604,165

(22) Filed: Jun. 27, 2000

(51) Int. Cl.[7] ..... B07C 5/344

(52) U.S. Cl. ..... 209/573; 108/26; 206/564; 206/725

(58) Field of Search ..... 209/571, 572, 209/573; 108/25, 26; 206/561, 564, 722, 725

(56) References Cited

U.S. PATENT DOCUMENTS 3,148,636 A * 9/1964 Bloomquist et al. ..... 108/26
4,593,820 A * 6/1986 Antonie et al. ..... 209/573
5,890,599 A * 4/1999 Murphy ..... 206/726 X
6,097,201 A * 8/2000 Slocum ..... 324/760

* cited by examiner

*Primary Examiner*—Tuan N. Nguyen

(57) ABSTRACT

A test station with multiple output bins on an output platform receives electronic devices under test. At each of the different output bins on the output platform, replaceable trays which accept the electronic devices are positioned. After testing of a device is completed, an automatic device handler removes a device from the test station and places it at an appropriate bin based on the test results. As the trays at each bin become full, the trays are removed and empty trays are placed at the bin. A unique guide is located near each bin position on the output platform and each tray is shaped to match one of the guides. When a tray is placed at a bin location, it will properly fit at only one bin. In certain embodiments, all the trays are identically shaped and a clip, which attaches to the side of a tray, is used to provide the complementary shape to one of the guides.

18 Claims, 4 Drawing Sheets

ERROR FREE TRAYS FOR BIN SORTING

FIELD OF THE INVENTION

The present invention relates to testing electronic devices, and more particularly to separating the devices according to their test results.

BACKGROUND OF THE INVENTION

Many different characteristics of electronic devices are tested during and after their manufacturing process. Some of the tests are simple pass/fail tests, such as power-up tests, while other tests are more complex, such as system level tests. One, relatively complex test is a speed rating test to determine the highest operating speed at which a device can performed. In such a test, a device, or plurality of devices, are placed in a test station for testing, and depending upon the test results, each device is then removed from the test station and sorted, or binned, according to its operating speed.

Because of the vast volume of electronic devices often being tested, efforts to automate the testing process are common in the industry. One typical automated improvement to the testing process is a robotic picker/placer arm which positions devices under test in a test station as well as positions them in output containers after testing. When utilizing automated robotic arms, some predetermined positioning and arrangements of the output containers are necessary so that the picker/placer arm's different movements can be programmed into it.

Each particular test-result category is associated with a "bin," thereby ensuring that devices with similar test results are identically binned. There is a distinct bin path on the output of the tester for each test-result category which accomplishes physical segregation of the devices under test. In other words, after testing, the test output handler forwards a device along an appropriate bin path such that similar devices are aggregated at a bin, which represents an aggregation of similarly categorized devices. The bin may be manifested by a tray or other container that will hold the categorized devices.

A test station, therefore, typically has multiple locations, or bins, where devices, after testing, are placed depending on their test performance. At each bin, a tray or other container is used to collect all the devices that are output to that particular bin. Usually, bins are organized in a predetermined arrangement scheme on some type of platform near the output of the test station. Upon test completion, the picker/placer arm extracts from the test station an electronic device and places it, depending on the bin identified by the test result, in an appropriate tray. The end result is that electronic devices having similar characteristics or performance constraints are segregated accordingly. Once a tray is filled, an operator removes the tray to a holding area and places an empty tray in its place.

The placement of the correct tray at the correct location, initially and during testing, is one step of the testing process that introduces errors. Placing a tray at an incorrect location, known as "bin mixing", is costly and time consuming because it requires the resulting misplaced electronic devices to be retested.

The prior art fails to provide an error-free and efficient method for ensuring the output trays of a test station are always properly positioned. Bin mixing, due to the current methods of testing of electronic devices, adversely affects both manufacturing quality assurance and cycle time and increases manufacturing costs.

SUMMARY OF THE INVENTION

There is a need for an error-free method of positioning output trays at a test station. These and other needs are met by embodiments of the present invention which provide a test station with multiple output bins on an output platform that receives an electronic device under test. At each of the different output bins on the output platform, replaceable trays which accept the electronic devices are positioned. After testing of the device is completed, an automatic device handler removes a device from the test station and places it at an appropriate bin based on the test results. As the trays at each bin become full, the trays are removed and empty trays are placed at the bin. A unique guide is located near each bin position on the output platform and each tray is shaped to match one of the guides. Thus, when a tray is placed at a bin location, it will properly fit at only one bin. In certain embodiments, all of the trays are similar and a clip which attaches to a side of a tray is used to provide the matching shape to one of the bin guides.

The needs are also met by embodiments of the present invention which provide for a platform surface, for supporting a plurality of trays, on which a plurality of guides are arranged; each tray being configured such that it only aligns with one of the guides. When the trays are positioned on the platform so that each is aligned with its corresponding guide, then each tray can occupy only a single location on the platform.

The needs are also met by embodiments of the present invention which provide for a platform which can receive articles only at discrete locations, each of these locations having an associated guide, and a plurality of trays, each of which is configured to match only one of the guides. When the trays are supported on the platform, each tray is positioned at the discrete location that is associated with the guide that matches that particular tray.

The foregoing features, as well as other aspects and advantages, of the present invention, will become more apparent from the following detailed description, claims and drawings.

DETAILED DESCRIPTION OF THE INVENTION

Figure 1:
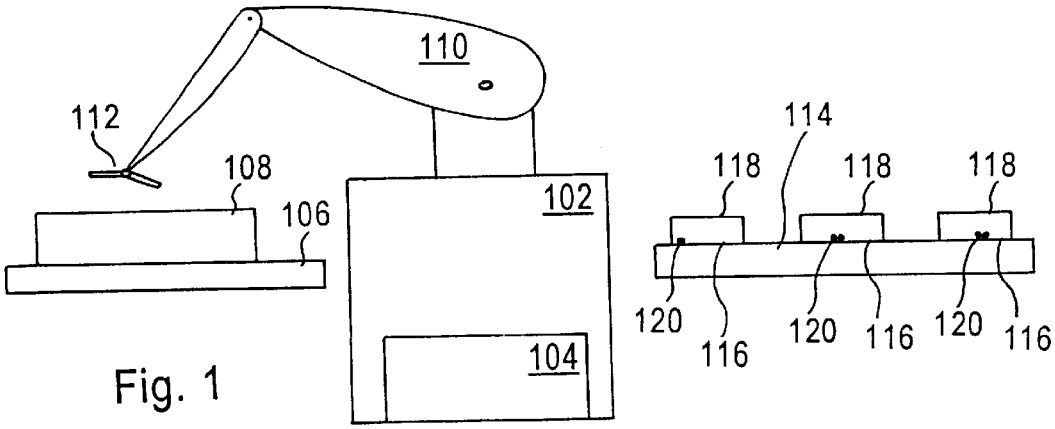
FIG. 1 illustrates a test station at which trays according to embodiments of the present invention are used.

FIG. 1 illustrates an exemplary test station 102 for testing electronic devices such as memory, processors, and other IC devices. An input platform 106 supports a container 108 which holds untested devices. A robotic picker/placer arm 110 is used to automatically pick devices from the container 108 and place them in a tester 104. The gripper 112 of the arm 110 can have various configurations which work in conjunction with the tester 104. Certain embodiments of the present invention pick and place a single device at a time, while other embodiments have a gang arrangement in order to simultaneously place multiple devices in a tester 104 which is able to receive them. Testing of the devices is performed under manual or automatic control of the tester 104 in order to determine performance characteristics of the devices. Depending on the test results, the arm 110 removes the devices from the tester 104 and places them at an appropriate output bin 116 on platform 114. The devices are segregated into appropriate trays 118 at output bins 116 by grouping them so that devices with similar test results are placed at the same bin. Each bin 116 has an associated guide 120 which assists with correct placement of each tray 118 as more fully described below.

Figure 2:
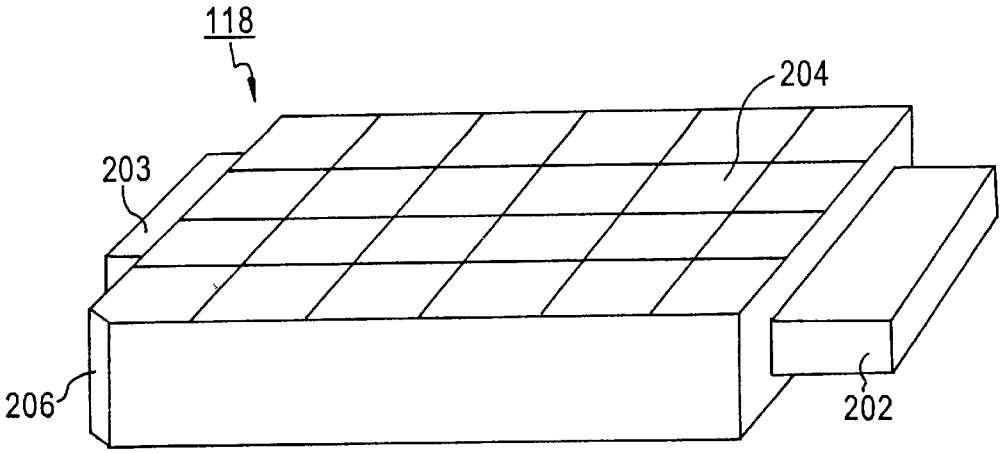
FIG. 2 illustrates an exemplary tray according to certain embodiments of the present invention.

FIG. 2 illustrates an exemplary tray 118 according to certain embodiments of the present invention which is particularly adapted to the environment of storing semiconductor devices. In certain embodiments, the tray 118 is a molded plastic JEDEC tray as is well known in the art. The tray 118 has a tab 202 on one side, a tab 203 on another side, and compartments 204 for holding individual devices. One corner 206, opposite the tab 202, is chamfered to allow a visual indication of the orientation of the tray 118.

Figure 3:
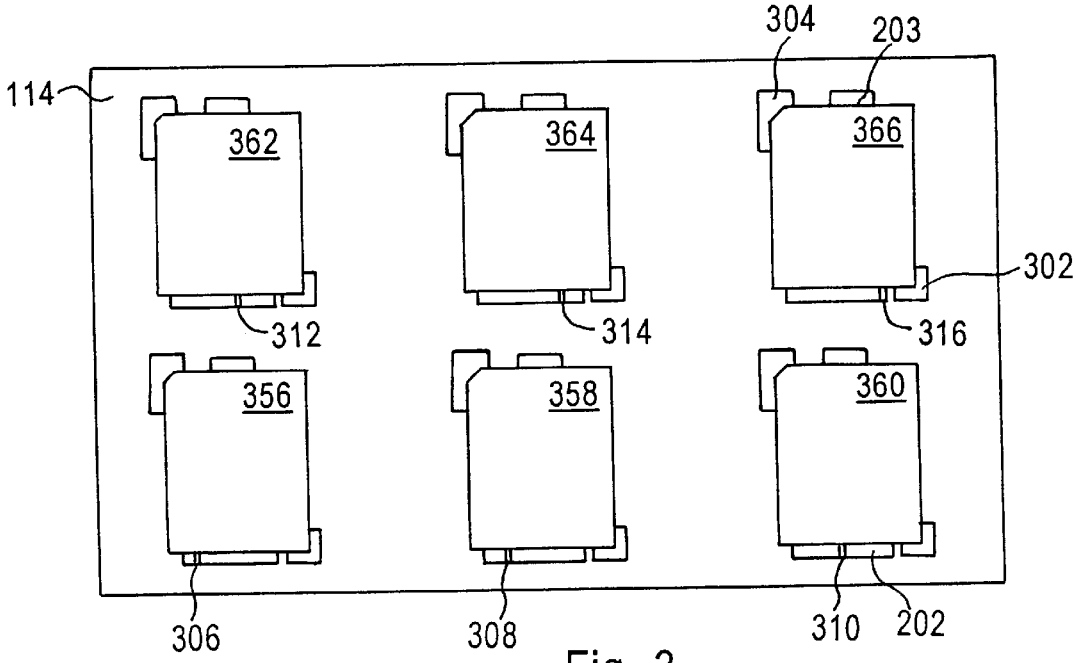
FIG. 3 illustrates a plan view of an output platform which supports trays according to certain embodiments of the present invention.

FIG. 3 illustrates an arrangement of the output platform 114 according to certain embodiments of the present invention. The platform 114 has six holding trays 356–366 such that each of the trays is located at one of the output bins 116. Other embodiments with more or less bins are also contemplated within the scope of the present invention. Each bin 116 has a pair of standard guides 302 and 304 which help ensure the trays 356–366 are properly located at the bins 116. One of the standard guides 304 is shaped to complement the chamfered edge 206 of the trays 356–366 to assist with proper orientation of the trays 356–366 so that the tab 202 is positioned adjacent to a unique guide 306–316. These unique guides 306–316 are constructed of sturdy plastic or metal and are rigidly fixed to the surface of the platform 114 where they are used to position each of the trays 356–366 at an appropriate output bin 116. The robotic arm (FIG. 1, 110) is programmed with the possible bin locations on platform 114 and also which bin corresponds to which test result.

With respect to their associated bins 116, each guide 306–316 is in a different position and the sides of trays 356–366 which are adjacent the guides 306–316 are shaped to interact with only one of the guides 306–316. Each tray 356–366 can occupy only a single unique bin position based on which guide 306–316 it matches. For example, tray 366 cannot be placed at the bottom, left most bin position occupied (in FIG. 3) by tray 356. This is because tray 366 is configured to interact with the guide 316 positioned at its lower right corner as seen in FIG. 3. Tray 366 will not properly interact with the guide 306 positioned at a lower left hand corner, or any other position other than the specified guide position for tray 366.

Figure 4:
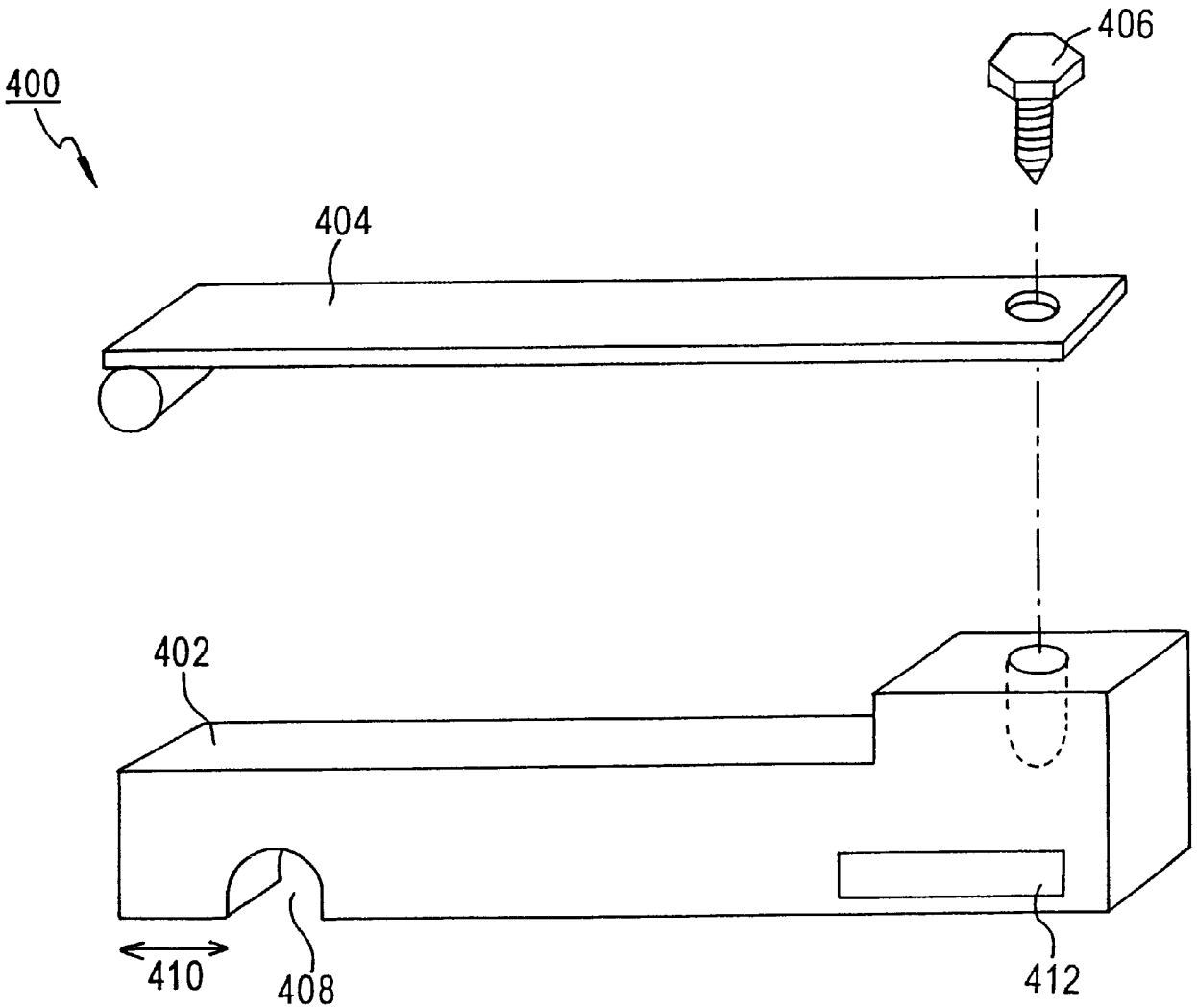
FIG. 4 illustrates a uniquely shaped tray clip according to certain embodiments of the present invention.

The clip 400 illustrated in FIG. 4, in certain embodiments of the present invention, attaches to a tray 356–366 and configures the tray to interact with only a single one of the unique guides 306–316. The clip 400 is formed from a substantially rectangular block 402 of aluminum, or other light metal or plastic, and a thin steel, or sheet metal, plate 404. The plate 404 is securely affixed to block 402 by screw 406 or other fasteners or bonding methods. The aluminum block 402 has a notch 408 which is a distance 410 from its edge. The notch 408 is shaped to fit the unique guides 306–316 and the distance 410 determines which one of the unique guides 306–316 the clip 400 matches. The embodiments illustrated in FIG. 4 rely on a distance 410 to determine a matching guide 306–316; however, other keying arrangements which result in the clip 400 matching only a single guide 306–316 are contemplated by the present invention.

Certain embodiments of the present invention include indicia 412 engraved or otherwise affixed to each clip 400 which identifies the bin with which the clip 400 corresponds. Not only does such indicia assist users in placing a tray 356–366 with an attached clip 400 on the platform 114, but also aids them when the trays 356–366 are transported from the platform 114 and the corresponding bin associations need to be determined.

Figure 5:
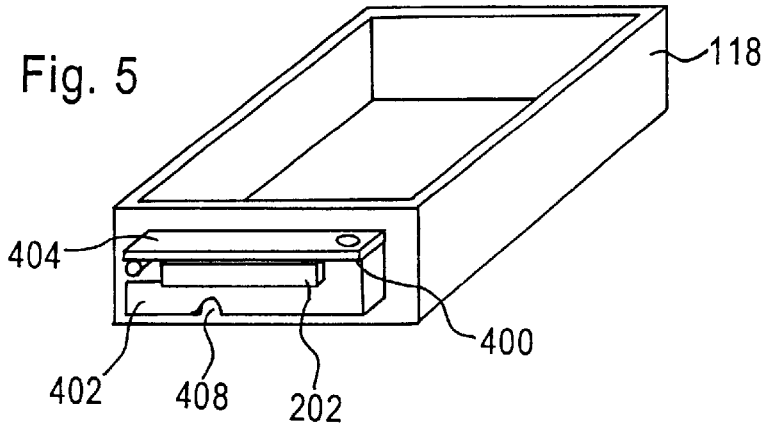
FIG. 5 illustrates a clip affixed to a tray according to certain embodiments of the present invention.

The plate 404 and block 402, when coupled, act together to securely, but temporarily, attach to the tab 202 of a tray 118 as depicted in FIG. 5. The exemplary clip 400, illustrated in FIG. 5, depicts a single, semi-circular notch 408 positioned to receive one of the unique guides 306–316. The guides 306–316 are shaped to complement the shape of the notch 408; an appropriately sized hemispherical protrusion is one example of a guide shaped to complement notch 408.

Figure 6:
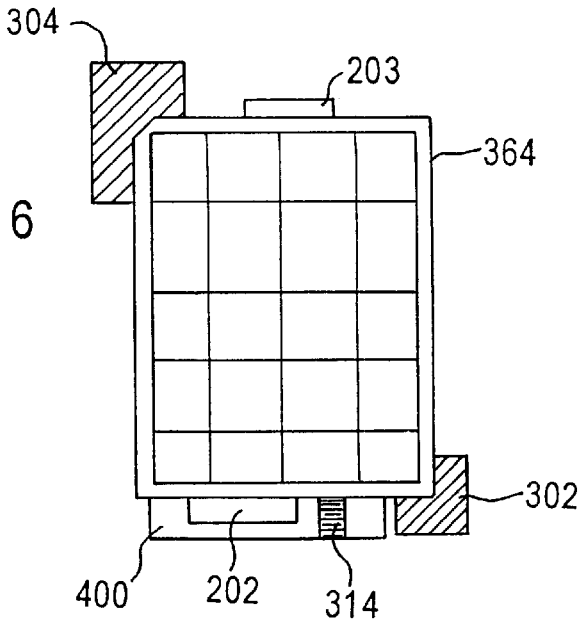
FIG. 6 illustrates a plan view of a tray, clip and guide according to certain embodiments of the present invention.

FIG. 6 illustrates a top view, according to certain embodiments of the present invention, of a single tray 364 from FIG. 3. The tray 364, which fits between standard guides 302 and 304, interacts with the unique guide 314. The arrangement of the clip 400 with the tray 314 and tab 202 is also depicted. Although FIG. 6 visibly illustrates every component, in practice, the clip 400 would obscure the tab 202 and the guide 314 when viewed from this perspective. A notch is not visibly depicted in this view but is located on clip 400 to only interact with guide 314.

Figure 7:
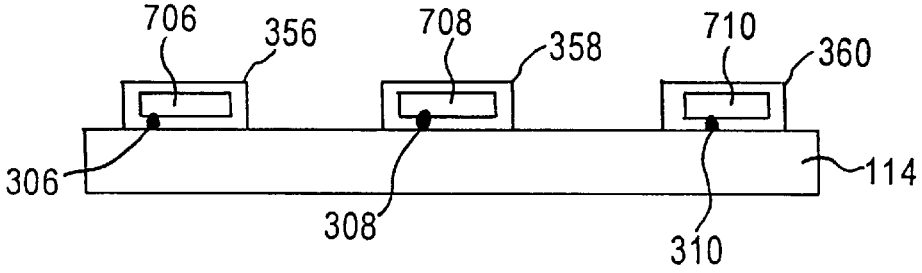
FIG. 7 illustrates a front view of an output platform and trays according to certain embodiments of the present invention.

FIG. 7 illustrates a front view of the platform 114 such that three trays 356–360 are visible. The clips 706–710 are shown attached to the trays 356–360 and the alignment of the clips 706–710 and the guides 306–310 are further illustrated. The three back trays 362–366 are not visible in this view but align with appropriate guides on the platform 114 as well.

Figure 8:
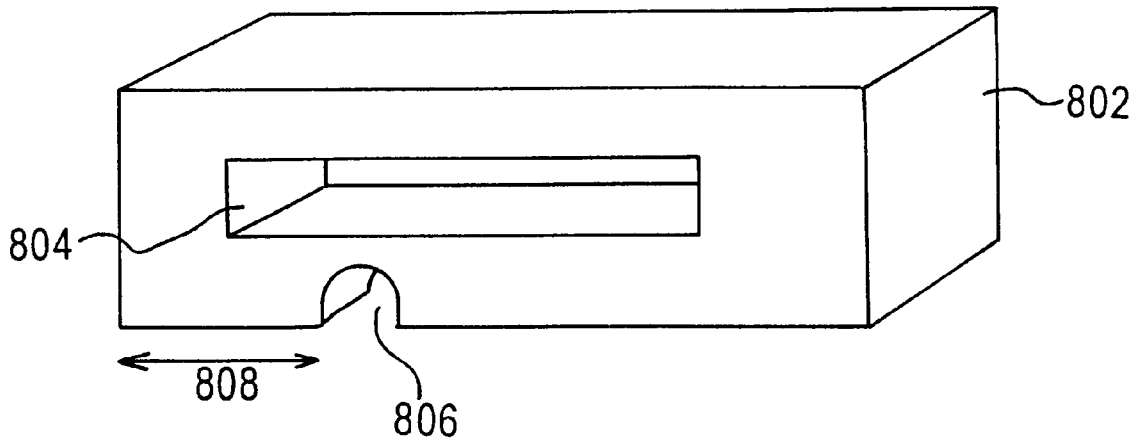
FIG. 8 illustrates a uniquely shaped tray clip according to other embodiments of the present invention.

FIG. 8 illustrates embodiments of the present invention in which clip 802 is a single piece of molded plastic or other sturdy material. The clip 802 has an opening 804 which accepts a tray tab (FIG. 2, 202) to attach the clip 802 to the side of a tray (FIG. 2, 118). A notch 806 is located a distance 808 from an edge of the block 802 so that when the clip 802 is attached to the tray 118, the tray can properly interact with only one of the unique guides 306–316.

Figure 9:
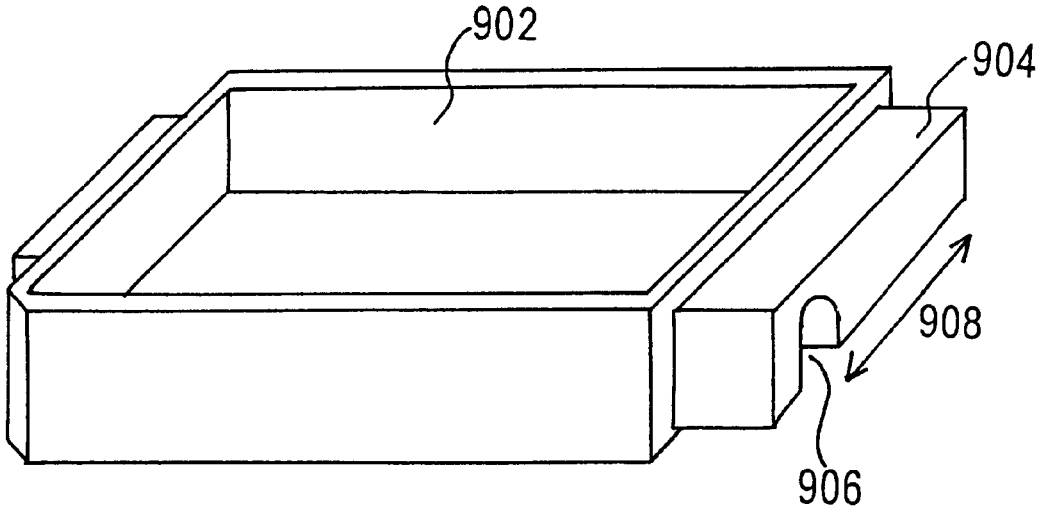
FIG. 9 illustrates an exemplary tray according to other embodiments of the present invention.

FIG. 9 illustrates embodiments of the present invention in which a tray 902 has a notch 906 formed integrally with a tab 904. Similar to the earlier described embodiments, the notch 906 is located a distance 908 from the edge of tab 904 so that the tray properly interacts with only a single unique guide 306–316.

Using certain embodiments of the present invention, personnel at a test station responsible for initially placing device trays at output bins, and replacing these trays as they become full, are prevented from putting a tray at incorrect output bins. In practice, a clip is attached to a JEDEC tray so that it only fits at a corresponding single bin position on the tester's output platform. When the tray and clip are positioned on the platform, they align with only one of the guides that have been previously formed on the platform, thus requiring a tray to be positioned in a location based on which clip is attached to that tray. This requirement prevents a tray intended for one output bin to be placed at another output bin. Because bin mixing is prevented, re-testing of devices is avoided which improves manufacturing expenses, efficiency and quality assurance.

Although the present invention has been described and illustrated in detail, it is understood that the same is by way of illustration and example only, and is not to be taken as a limitation, in scope or spirit, of the present invention which is limited only by the terms of the appended claims.

What is claimed is:

1. A tray positioning apparatus for an integrated circuit tester, comprising:

a plurality of trays;

a platform comprising:

a first surface configured to support the plurality of trays on the first surface; and a plurality of guides arranged on the first surface;

each of the plurality of trays comprising a first side configured to interact with only a corresponding one of the plurality of guides, wherein each of the plurality of trays is positionable at only a single location on the first surface of the platform when the first side of that tray interacts with the corresponding one of the plurality of guides.

2. An apparatus for receiving sorted articles comprising:

a platform, having a first surface, configured to receive articles at a plurality of discrete locations on the first surface;

a plurality of guides arranged on the first surface, wherein each of the plurality of guides is associated with one of the plurality of discrete locations;

a plurality of trays, each tray having a first side configured to uniquely match one of the plurality of guides and each tray further configured to hold the articles; and the platform further configured to support the plurality of trays on the first surface; wherein, when supported on the platform, each of the plurality of trays is located at a predetermined position, the predetermined position being located at the discrete location associated with the guide which matches that tray's first side.

3. A tray positioning apparatus for an integrated circuit tester, comprising:

a plurality of trays;

a platform comprising:

a first surface configured to support the plurality of trays on the first surface; and a plurality of guides arranged on the first surface;

each of the plurality of trays comprising a first side configured to interact with only a corresponding one of the plurality of guides, wherein each of the plurality of trays is positionable at only a single location on the first surface of the platform when the first side of that tray interacts with the corresponding one of the plurality of guides;

a removable clip configured to couple with the first side of one of the plurality of trays, wherein the clip is shaped to complement and receive a corresponding one of the plurality of guides.

4. The tray positioning apparatus of claim 3, wherein each of the plurality of trays further comprise compartments configured to hold integrated circuit devices.

5. The tray positioning apparatus of claim 3, wherein the plurality of trays are constructed from molded plastic.

6. The tray positioning apparatus of claim 3, wherein the removable clip further comprises:

a substantially rectangular block having a bottom and a top edge;

the top edge having a first portion offset from a second portion;

the bottom edge configured to complement a corresponding one of the plurality of guides; and a plate affixed to the first portion of the top edge, wherein the plate and the second portion form an opening configured to receive a part of the first side of one of the plurality of trays.

7. The tray positioning apparatus of claim 6, wherein the substantially rectangular block further comprises a label which is related to the corresponding one of the plurality of guides.

8. The tray positioning apparatus of claim 6, wherein the substantially rectangular block is constructed from aluminum.

9. The tray positioning apparatus of claim 3, wherein each of the plurality of guides are a hemispherical protrusion.

10. The tray positioning apparatus of claim 3, wherein:

the platform is configured to receive articles at a plurality of discrete locations and the plurality of guides are arranged on the first surface such that when one of the plurality of trays is aligned with the corresponding one of the plurality of guides, that one tray is positioned at one of the plurality of discrete locations.

11. An apparatus for receiving sorted articles comprising:

a platform, having a first surface, configured to receive articles at a plurality of discrete locations on the first surface;

a plurality of guides arranged on the first surface, wherein each of the plurality of guides is associated with one of the plurality of discrete locations;

a plurality of trays, each tray having a first side configured to uniquely match one of the plurality of guides and each tray further configured to hold the articles; and the platform further configured to support the plurality of trays on the first surface; wherein, when supported on the platform, each of the plurality of trays is located at a predetermined position, the predetermined position being located at the discrete location associated with the guide which matches that tray's first side;

a removable clip configured to couple with the first side of one of the plurality of trays, wherein the clip is shaped to complement a corresponding one of the plurality of guides.

12. The apparatus for receiving sorted articles of claim 11, wherein the removable clip further comprises:

a substantially rectangular block having a bottom and a top edge;

the top edge having a first portion offset from a second portion;

the bottom edge configured to complement a corresponding one of the plurality of guides; and a plate affixed to the first portion of the top edge, wherein the plate and the second portion form an opening configured to receive a part of the first of one of the plurality of trays.

13. A semiconductor device testing station comprising:

a tester configured to test an electronic device;

a plurality of trays configured to hold the electronic device;

an output platform comprising:

a first surface;

a plurality of output bins arranged on the first surface, each bin configured to hold one of the plurality of trays; and a plurality of guides on the first surface, each of the plurality of guides associated with a corresponding one of the plurality of output bins;

each of the plurality of trays further comprising a first side configured to interact with only a corresponding one of the plurality of guides, wherein each of the plurality of trays is positioned at a selected one of the plurality of output bins associated with the corresponding one of the plurality of guides;

a robotic arm configured to remove the device from the tester and further configured to place the device at one of the plurality of output bins after the tester completes testing of the device.

14. A semiconductor device testing station comprising:

a tester configured to test an electronic device;

a plurality of trays configured to hold the electronic device;

an output platform comprising:

a first surface;

a plurality of output bins arranged on the first surface, each bin configured to hold one of the plurality of trays; and a plurality of guides on the first surface, each of the plurality of guides associated with a corresponding one of the plurality of output bins;

each of the plurality of trays further comprising a first side interact with only a corresponding one of the plurality of guides, wherein each plurality of trays is positioned at a selected one of the plurality of output bins associated with the corresponding one of the plurality of guides;

a robotic arm configured to remove the device from the tester and further configured to place the device at one of the plurality of output bins after the tester completes testing of the device; and a removable clip configured to couple with the first side of one of the plurality of trays, wherein the clip is shaped to complement and receive a corresponding one of the plurality of guides.

15. The semiconductor testing station of claim 14, wherein the removable clip further comprises:

a substantially rectangular block having a bottom and a top edge;

the top edge having a first portion offset from a second portion;

the bottom edge configured to complement a corresponding one of the plurality of guides; and a plate affixed to the first portion of the top edge, wherein the plate and the second portion form an opening configured to receive a part of the first of one of the plurality of trays.

16. The semiconductor device testing station of claim 15, wherein the substantially rectangular block further comprises a label which is related to the corresponding one of the plurality of guides.

17. The semiconductor device testing station of claim 14, wherein each of the plurality of trays further comprise compartments configured to hold integrated circuit devices.

18. The semiconductor device testing station of claim 14, wherein the plurality of trays are constructed from molded plastic.

* * * * *

UNITED STATES PATENT AND TRADEMARK OFFICE

CERTIFICATE OF CORRECTION

PATENT NO. : 6,384,361 B1
DATED : May 7, 2002
INVENTOR(S) : Gune Rahul Vijaykumar It is certified that error appears in the above-identified patent and that said Letters Patent is hereby corrected as shown below:

Column 7,
Lines 13-14, after "a first side", please insert -- configured to --.

Signed and Sealed this

Twenty-fifth Day of June, 2002

*Attest:*

*Attesting Officer*

JAMES E. ROGAN
*Director of the United States Patent and Trademark Office*